US006185890B1

(12) United States Patent
Ritter

(10) Patent No.: US 6,185,890 B1
(45) Date of Patent: Feb. 13, 2001

(54) BUILDING ELEMENT

(75) Inventor: Klaus Ritter, Graz (AT)

(73) Assignee: EVG Entwicklungs- u. Verwertungs-Gesellschaft m.b.H., Raaba (AT)

( * ) Notice: Under 35 U.S.C. 154(b), the term of this patent shall be extended for 0 days.

(21) Appl. No.: 08/976,198

(22) Filed: Nov. 21, 1997

(30) Foreign Application Priority Data

Nov. 21, 1996 (AT) ..... 2031/96

(51) Int. Cl.[7] ..... E04C 2/288

(52) U.S. Cl. ..... 52/309.11; 52/251; 52/309.7; 52/309.12; 52/405.3; 52/381; 52/383; 52/650.2

(58) Field of Search ..... 52/509.7, 405.3, 52/405.4, 409, 410, 576, 577, 600, 605, 309.11, 309.12, 309.17, 251, 381, 383, 650.2

(56) References Cited

U.S. PATENT DOCUMENTS

| | | | | |
|---|---|---|---|---|
| 3,305,991 | * | 2/1967 | Weismann . | |
| 3,879,908 | * | 4/1975 | Weismann | 52/309 |
| 4,079,560 | * | 3/1978 | Weismann | 52/309.7 |
| 4,104,842 | * | 8/1978 | Rockstead | 52/650 |
| 4,297,820 | * | 11/1981 | Artzer | 52/309.11 |
| 4,454,702 | | 6/1984 | Bonilla-Lugo et al. . | |
| 4,505,019 | * | 3/1985 | Deinzer | 29/432 |
| 4,541,164 | * | 9/1985 | Monzon Indave | 29/430 |
| 4,702,053 | * | 10/1987 | Hibbard | 52/309.7 |

FOREIGN PATENT DOCUMENTS

WO 94/28264 12/1994 (WO) .

* cited by examiner

*Primary Examiner*—Carl D. Friedman
*Assistant Examiner*—Yvonne M. Horton
(74) *Attorney, Agent, or Firm*—Frishauf, Holtz, Goodman, Langer & Chick, P.C.

(57) ABSTRACT

To improve sound damping in prefabricated building elements having two parallel welded wire mesh mats 1, 2, interconnected by web wires 7, 7' enclose, therebetween, an insulating body (8) for example of foam plastic. Concrete is then sprayed on both sides over the mesh wires to form inner and outer shells. These concrete shells are interconnected by forming the insulating body with through-holes, which, upon concrete spraying, will form concrete webs or plugs (14, 14') interconnecting the two shells, thus preventing resonant sound vibrations of the concrete shells. The through-holes (10, 11, 11') can be molded during manufacture of the insulating body (8) or drilled or stamped therethrough, and may extend at right angles through the major extent of the foam body or obliquely, preferably downwardly and distributed randomly.

9 Claims, 2 Drawing Sheets

BUILDING ELEMENT

Reference to related Patent and Application, the disclosures of which are hereby incorporated by reference:

U.S. Pat. No. 4,454,702

U.S. application Ser. No. 08/556,924, filed Nov. 29, 1995, Ritter et al.

FIELD OF THE INVENTION

The invention concerns a structural member having two parallel welded wire mesh mats forming outer and inner mats, straight web wires which keep the wire mesh mats at a predetermined distance from each other and connected at each end to the two wire mesh mats, and an insulating body which is arranged with its top and bottom or outer and inner surfaces parallel to the wire mesh mats and at a predetermined distance therefrom. The web wires pass through the insulating body.

BACKGROUND

A building element of this kind is described in U.S. application Ser. No. 08/556,924, Ritter et al. filed Nov. 29, 1995, to which International Publication WO 94/28264 corresponds. The insulating body can have hollow spaces which, however, do not extend to the top and bottom surfaces of the insulating body. At the building site, the building element is provided on both surfaces with a layer of concrete and mortar covering the wire mesh mats. It has been found that this building element may be subject to resonance vibrations of the two concrete shells in a wide frequency range. This reduces the sound damping capability of the building element.

U.S. Patent No. 4,454,702 discloses a structural member comprising an insulating body which is provided with some through-holes each reinforced by a spacer wire. This structural member is first constructed on site from the individual components such as wire mesh mats, insulating body and spacers and finally surrounded in concrete on the wire mesh mats on both sides. In this case the through-holes are also filled with concrete walls. A disadvantage with this method of production is that the structural member is constructed only on site. The number and dimensions of the through-holes are not specified in more detail.

THE INVENTION

It is an object of the invention to avoid the drawbacks described for the known structural members and to provide a structural member which is supplied to the site already prefabricated and, in addition to good heat insulating values, exhibits good sound insulation values over the whole audible frequency range.

Briefly, the structural member according to the invention is formed with at least one straight through-hole in the insulating body extending between major surfaces thereof e.g., the top and bottom or front and rear surfaces.

In accordance with a feature of the invention, the one, or at least one through-hole extends perpendicularly to the top and bottom, or front and rear, or, with respect to the wire mats, outer and inner surfaces of the insulating body. According to another feature of the invention the one or at least one through-hole can extend at a predetermined angle obliquely to the top and bottom surfaces of the insulating body, wherein the through-hole extends, when the structural member is used as a vertical wall element, obliquely downwards. Preferably in this case each oblique through-hole extends parallel to the longitudinal wires and/or parallel to the cross wires of the wire mesh mats.

According to another feature of the invention each through-hole has a round cross-section with a diameter within the range from 50 to 100 mm; this obtains the desired effect, without degrading sound and heat insulation, and structural strength.

The invention also includes a method for sheathing a structural member of the kind indicated above. With this method the procedure is such that a concrete outer or front shell which adjoins the insulating body or the separating layer adjacent to the outer wire mesh mat is applied to the outer wire mesh mat. The outer mat is designed to form the outside of the structural member. The outer wire mesh mat is surrounded by concrete, and together with the latter form a load-bearing part of the structural member; a concrete inner or rear shell which adjoins the insulating body or the separating layer adjacent to the inner wire mesh mat is applied to the inner mesh mat, which is designed to form the inside of the structural member, which surrounds the inner wire mesh mat and together with the latter forms a load-bearing part of the structural member. At the same time, each through-hole is filled with a concrete web which connects the concrete outer shell and the concrete inner shell in force-interlocking, interengaging relationship, so that, when the concrete sets, cures and hardens, a unitary concrete reinforced concrete structure, with an insulating core, will be obtained.

With the invention, the structural member can be prefabricated at the factory and exhibits optimum sound and heat insulation values with a high load-carrying capacity.

DRAWINGS

Practical examples are shown in the drawings, wherein

DETAILED DESCRIPTION

Figure 1:
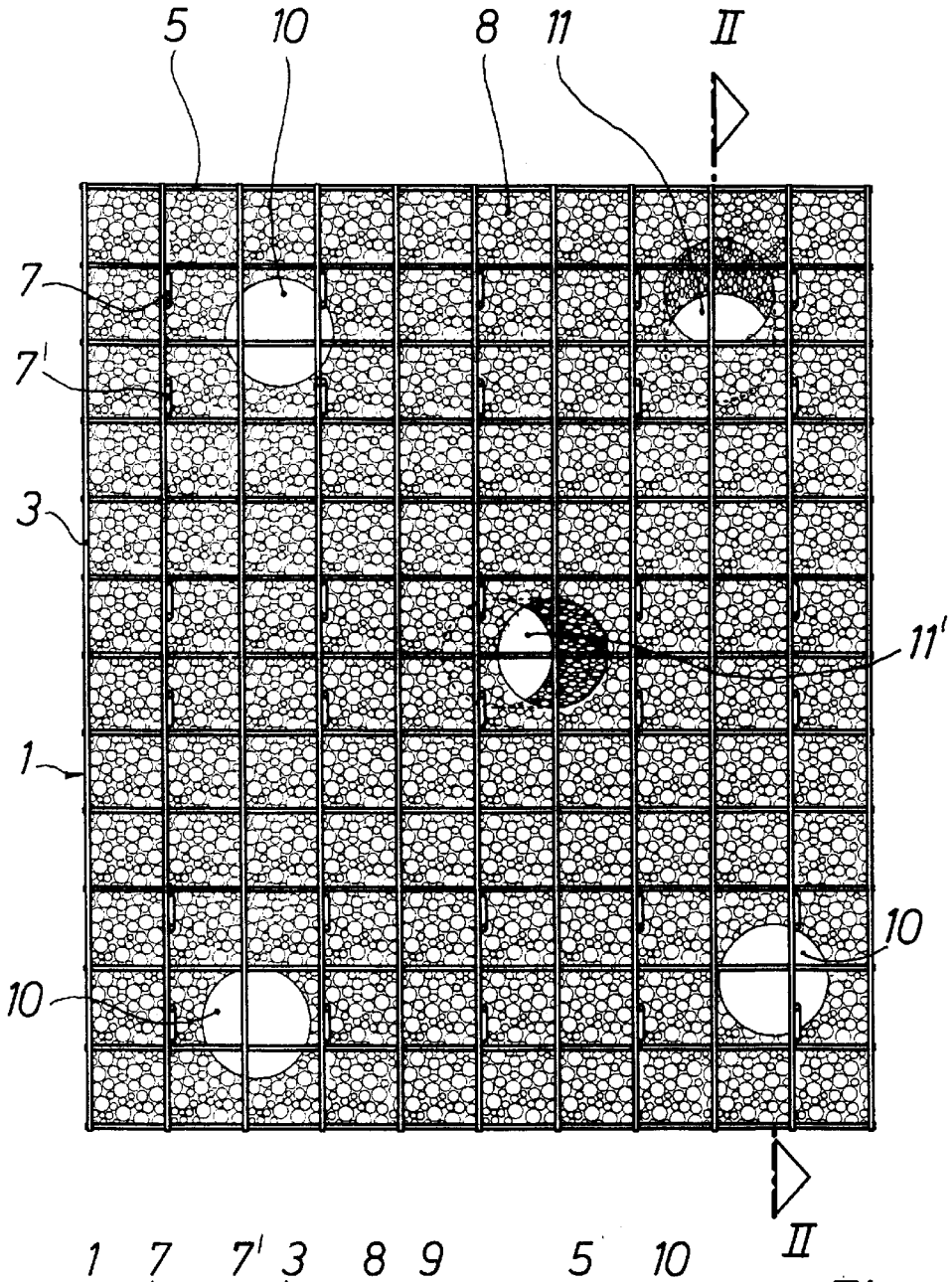
FIG. 1 shows a structural member according to the invention in a top view.
Figure 2:
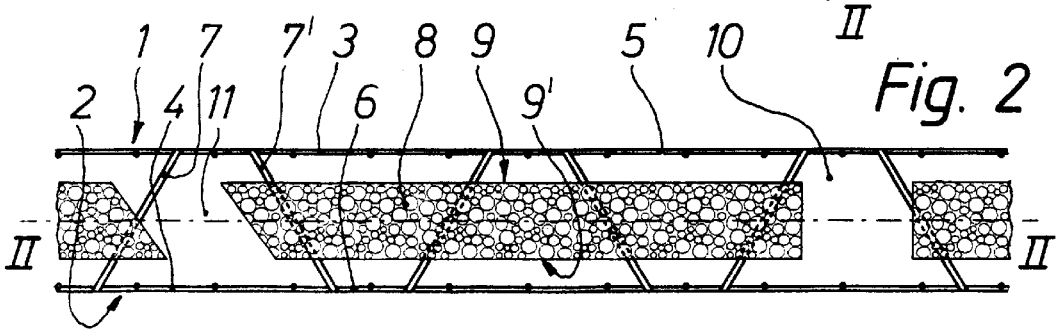
FIG. 2 shows a section through the structural member according to FIG. 1 along the line II—II.
Figure 3:
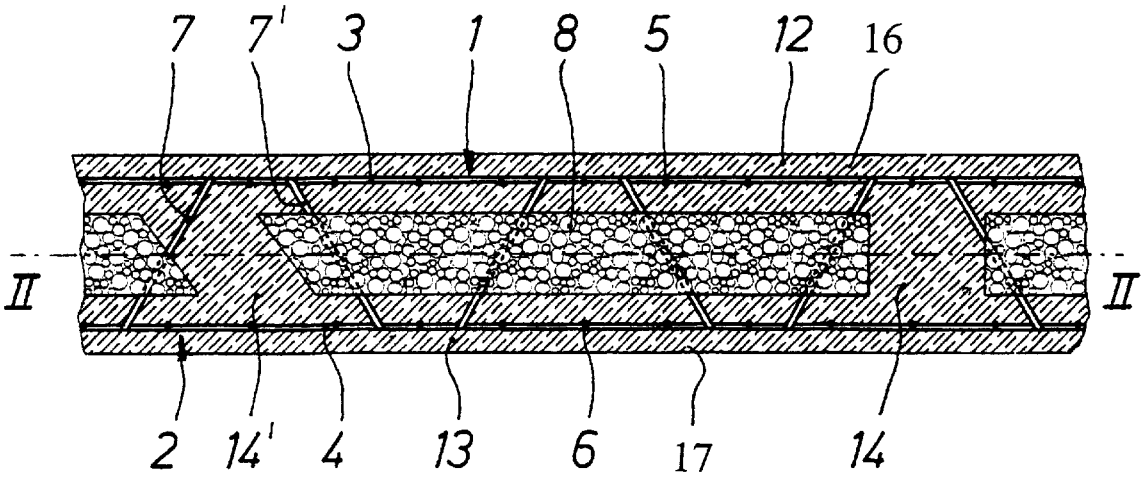
FIG. 3 is a cross-sectional view of a structural member with an outer shell and an inner shell and connecting webs or plugs, all of concrete.

The structural member shown in a top view in FIG. 1 in a section along line II—II in FIG. 2 and in a cross-sectional view, when finished with concrete, in FIG. 3 is formed of outer and inner wire mesh mats 1 and 2 respectively, which are arranged parallel to and at a predetermined distance from each other. Each wire mesh mat 1 or 2 has several longitudinal wires 3 or 4 and several cross wires 5 or 6 which cross each other and are welded together at the points of intersection. The distance between the longitudinal wires 3, 4 and between the cross wires 5, 6 is selected according to the static requirements of the structural member, and for example is within the range of 50 to 150 mm. The distances can be equal, or different.

The diameters of the longitudinal and cross wires 3, 4 or 5, 6 are also selectable according to the static requirements and are preferably within the range from 2 to 6 mm. The surface of the wire mesh mats 3, 4, 5, 6 can be, within the scope of the invention smooth or ribbed.

The two wire mesh mats 1, 2 are joined together by several web wires 7, 7' into a dimensionally stable mesh body. The web wires 7, 7' are welded at their respective ends to the wires of the two wire mesh mats 1, 2, wherein, within the scope of the invention, the web wires 7, 7' are welded either, as shown in FIG. 1, to the respective longitudinal wires 3, 4 or to the cross wires 5, 6. The web wires 7, 7' are arranged obliquely alternately in opposite directions, i.e. like a trellis as a result of which the mesh body is reinforced against shear stress.

An insulating body 8 is arranged in the gap between the wire mesh mats 1, 2, at a predetermined distance from the wire mesh mats. The insulating body 8 has top and bottom, or outside and inside surfaces 9 and 9' which run parallel to the wire mesh mats 1, 2. The insulating body 8 serves for heat and sound insulation and for example is made of foam plastics such as polystyrene or polyurethane foam.

The thickness of the insulating body 8 is freely selectable and is, for example, within the range from 20 to 200 mm. The distances from the insulating body 8 to the wire mesh mats 1, 2 are also freely selectable and are, for example, within the range from 10 to 30 mm. The structural member can be made in any length and width. On the basis of the method of production, a minimum length of 100 cm and standard widths of 60 cm, 100 cm, 110 cm, 120 cm have proved to be advantageous.

In accordance with the invention several through-holes 10, 11, 11' are formed in the insulating body 8. The through-holes 10, 11, 11' extend perpendicularly and/or at a selectable angle, obliquely, to the top and bottom surfaces 9, 9' of the insulating body 8. The through-holes 10, 11, 11' can be drilled in the insulating body 8 or stamped out of it. Within the scope of the invention it is also possible to make the through-holes 10, 11, 11' during production of the insulating body by suitable shaping of the molding dies. The directions of the obliquely extending through-holes 11, 11' are selected in such a way that, if the structural member is used as a vertical wall, at least the through-holes 11, 11' of one type extend obliquely downwards, with respect to directions which are parallel to the longitudinal wires 3, 4 and/or parallel to the cross wires 5, 6 of the wire mesh mats 1, 2. The number, dimensions and distribution of all through-holes 10, 11, 11' are freely selectable. The number and dimensions should not be selected too large, in order not to impair too greatly the heat insulation values of the structural member. A preferred number is, for example, between two and six per $m^2$. The shape of the through-holes 10, 11, 11' can also be selected as desired and may be for example square, rectangular or round. In case of a round cross-section of the through-holes 10, 11, 11' the diameters are preferably within the range from 50 to 100 mm. It is within the scope of the invention that the distribution of the through-holes 10, 11, 11' in the structural member can be regular or random. A random asymmetrical distribution of the through-holes 10, 11, 11' is advantageous to avoid resonance effects.

FIG. 3 shows a section through the prefabricated structural member according to the invention, provided with an outer shell 16 and an inner shell 17, the section corresponding to the section shown in FIG. 2. In this case the perpendicular through-holes 10 are filled, each, with a perpendicular concrete web or plug 14, connecting the two concrete shells 16, 17. The oblique through-holes 11, 11' are each filled with an also oblique concrete web or plug 14' connecting the two concrete shells 16, 17. The concrete shells 16, 17 and the concrete webs 14, 14' can be made by spraying and/or casting methods.

What is claimed is:

1. A structural member comprising:

two parallel welded wire mesh mats (1, 2) and individual straight web wires (7) joined at each end to said mats for keeping the mats at a predetermined distance from each other, the individual straight web wires (7) being arranged in rows connecting the two wire mesh mate, and a one-piece prefabricated insulating body (8) spanning more than two of said rows of web wires and defining two opposite surfaces arranged parallel to and positioned between the wire mesh mats (1, 2) and at a predetermined distance therefrom, said insulating body being pierced by said web wires, wherein at least one straight through-hole (10) and at least one oblique through-hole (11, 11') are formed in the insulating body (8) between the opposite surfaces (9, 9') thereof, wherein said at least one straight through-hole extends perpendicularly to said surfaces of the insulating body and wherein said at least one oblique through-hole extends at a predetermined angle obliquely to the surfaces of the insulations body.

2. The structural member according to claim 1, wherein said wire mesh mats comprise parallel rows of longitudinal wires (3,4) and parallel rows of cross wires (5, 6) that are perpendicular to said longitudinal wires, characterized in that the at least one oblique through-hole (11, 11') extends parallel to said longitudinal wires (3, 4) or parallel to said cross wires (5, 6) of said wire mesh mats.

3. The structural member according to claim 1, characterized in that said oblique through-hole (11, 11') extends, when the structural member is used as a vertical wall element, obliquely downwardly.

4. The structural member according to claim 3, wherein the wire mesh mats are formed by parallel longitudinal wires intersecting with parallel cross wires and the mats are aligned with each other such that respective longitudinal wires correspond and respective cross wires correspond, with respective corresponding longitudinal wires in said mats defining a first group of parallel planes and respective corresponding cross wires in said mats defining a second group of parallel planes, and characterized in that each said obliquely extending through-hole (11, 11') extends parallel to the first group of planes or parallel to the second group of planes.

5. The structural member according to claim 1, characterized in that the insulating body (8) comprises two to six through-holes (10, 11, 11') per $m^2$.

6. The structural member according to claim 1, characterized in that each through-hole (10, 11, 11') has a round cross-section with a diameter within the range from 50 to 100 mm.

7. The structural member according to claim 1, characterized in that a plurality of through-holes (10, 11, 11') are formed in the insulating body (8), and that the distribution of the through-holes (10, 11, 11') in the structural member is random.

8. Method for sheathing a structural member comprising;

providing two parallel welded wire mesh mats (1, 2) and individual straight web wires (7) joined at each end to said mats for keeping the mats at a predetermined distance from each other, the individual straight web wires being arranged in rows connecting the two wire mesh mats, providing a one-piece, prefabricated insulating body (8) spanning more than two of said rows of web wires and defining two opposite surfaces (9, 9') parallel to and positioned between the wire mesh mats (1, 2) and at a predetermined distance therefrom, said insulating body being pierced by said web wires, forming at least one straight through-hole (10) and at least one oblique through-hole (11, 11') in the insulating body (8) between the opposite surfaces thereof, wherein said at least one straight through-hole extends perpendicularly to said surfaces of the insulating body and wherein said at least one oblique through-hole extends at a predetermined angle obliquely to the surfaces of the insulating body, applying a concrete outer shell (12) to one of said two wire mesh mats (1), which is designed to form the outside of the structural member, applying a concrete inner shell (13) to the other of said two wire mesh mats (2), which is designed to form the inside of the structural member, and filling, at the same time during said application steps, each said straight and oblique through-holes (10, 11, 11') with a concrete web or plug (14, 14') which connect the concrete outer shell (12) and the concrete inner shell (13).

9. The method of claim 8, further including the step of permitting the concrete shells (12, 13) and the concrete webs or plugs (14, 14') to set and cure together to form a unitary concrete structure.

* * * * *